US011498039B2

(12) United States Patent
Damar

(10) Patent No.: US 11,498,039 B2
(45) Date of Patent: Nov. 15, 2022

(54) PLANET CENTRIFUGE MIXING SYSTEM FOR SOFT PACKAGING

(71) Applicant: YDR TEKNOLOJI GELISTIRME LIMITED SIRKETI, Istanbul (TR)

(72) Inventor: Olcay Yilmaz Damar, Istanbul (TR)

(73) Assignee: YDR TEKNOLOJI GELISTIRME LIMITED SIRKETI, Istanbul (TR)

( * ) Notice: Subject to any disclaimer, the term of this patent is extended or adjusted under 35 U.S.C. 154(b) by 481 days.

(21) Appl. No.: 16/607,073

(22) PCT Filed: Apr. 20, 2018

(86) PCT No.: PCT/TR2018/050181
§ 371 (c)(1),
(2) Date: Oct. 21, 2019

(87) PCT Pub. No.: WO2018/236321
PCT Pub. Date: Dec. 27, 2018

(65) Prior Publication Data

US 2020/0376451 A1 Dec. 3, 2020

(30) Foreign Application Priority Data

Apr. 24, 2017 (TR) ..... 2017/06011

(51) Int. Cl.
*B01F 9/00* (2006.01)
*B01F 13/00* (2006.01)
(Continued)

(52) U.S. Cl.
CPC ..... *B01F 29/10* (2022.01); *B01F 29/15* (2022.01); *B01F 29/30* (2022.01); *B01F 33/84* (2022.01); *B01F 35/513* (2022.01); *B01F 35/714* (2022.01); *B65B 3/04* (2013.01); *B65B 7/28* (2013.01); *B01F 2101/21* (2022.01)

(58) Field of Classification Search
CPC ..... B01F 29/15; B01F 29/30; B01F 33/84; B01F 35/513; B01F 35/714; B01F 2101/21; B65B 3/04; B65B 7/28
See application file for complete search history.

(56) References Cited

U.S. PATENT DOCUMENTS 5,551,779 A * 9/1996 Gantner ..... B01F 35/421 366/217
6,099,160 A * 8/2000 Flackett ..... B01F 35/50 366/217

(Continued)

FOREIGN PATENT DOCUMENTS

EP 2457645 A1 * 5/2012 ..... B01F 15/00175
JP 2000246082 9/2000
WO 2009137480 11/2009

OTHER PUBLICATIONS

ISR, dated Feb. 11, 2019.

*Primary Examiner* — Thomas M Wittenschlaeger
*Assistant Examiner* — David G Shutty
(74) *Attorney, Agent, or Firm* — Crose Law LLC; Bradley D. Crose

(57) ABSTRACT

Present invention relates to a new soft/bag packaging mixing system and method that allows the mixing of materials contained in soft/bag packages and obtaining of a homogeneous mixture by utilizing the physical characteristics of said packages through applying different types of forces.

2 Claims, 5 Drawing Sheets

(51) Int. Cl.

| | |
|---|---|
| ***B01F 15/00*** | (2006.01) |
| ***B01F 15/02*** | (2006.01) |
| ***B65B 3/04*** | (2006.01) |
| ***B01F 29/10*** | (2022.01) |
| ***B65B 7/28*** | (2006.01) |
| ***B01F 29/15*** | (2022.01) |
| ***B01F 29/30*** | (2022.01) |
| ***B01F 33/84*** | (2022.01) |
| ***B01F 35/513*** | (2022.01) |
| ***B01F 35/71*** | (2022.01) |
| *B01F 101/21* | (2022.01) |

(56) References Cited

U.S. PATENT DOCUMENTS 6,681,550 B1 * 1/2004 Aylward ..... B65B 5/103 53/244
6,709,151 B2 * 3/2004 Schmidt ..... B01F 29/10 366/217
6,755,565 B2 * 6/2004 Flackett ..... B01F 29/10 366/217
6,767,126 B2 * 7/2004 Miller ..... B01F 35/421 366/217
7,255,247 B2 * 8/2007 Aylward ..... B65B 35/08 221/277
7,438,460 B2 * 10/2008 Schmidt ..... B01F 33/70 366/217
7,445,373 B2 * 11/2008 Huckby ..... B01F 29/40 366/217
9,044,717 B2 * 6/2015 Yao ..... B02C 17/1815
9,909,244 B2 * 3/2018 Gueller ..... D06F 21/08
10,723,492 B2 * 7/2020 Kieselhorst ..... G01G 13/006
2003/0198126 A1 * 10/2003 Flackett ..... B01F 29/40 366/217
2006/0109739 A1 * 5/2006 Huckby ..... B01F 35/425 366/208
2006/0180234 A1 * 8/2006 Aylward ..... B65B 35/08 141/71
2007/0002682 A1 * 1/2007 Vanderbilt ..... B01F 29/10 366/217
2008/0197223 A1 * 8/2008 Nagao ..... B02C 17/08 241/175
2009/0281663 A1 * 11/2009 Robida ..... B01F 35/221422 700/265

* cited by examiner

PLANET CENTRIFUGE MIXING SYSTEM FOR SOFT PACKAGING

FIELD OF THE INVENTION

Present invention relates to a new soft/bag packaging mixing system and a method that allows the mixing of materials contained in soft/bag packages and obtaining of a homogeneous mixture by utilizing the physical characteristics of said packages through applying different types of forces.

BACKGROUND OF THE INVENTION

A centrifuge is a piece of equipment that turns the containers inside the machine at such high-speeds that allows the materials with different densities contained inside the said containers to be separated through the centrifugal force. Suspension or emulsion mixtures to be separated are put inside the tubes that are located around the centrifuge equipment in a suspended position inside the internal volume. A centrifuge generally works on an electric motor and performs a circular rotation motion on a fixed axis. Once the centrifuge is activated, tubes inside the centrifuge machine are positioned horizontally to begin their rotational motion and through the centrifugal force while some of the substances contained inside the tubes accumulated at the bottom of the tube, other materials with lower density move towards the top. Thus, suspension and emulsion mixtures are separated.

The equipment of centrifuge is actively being used in various fields such as production of serums, decomposition of suspensions and isotope separation.

The application bearing number "JPH0483165A" refers to a device and a method to be used during the blood decomposition process in order to obtain blood serum and to be able to use the blood afterwards. In this aforementioned application there is a glass tube to accumulate the blood.

Another application bearing number "WO2014160125A" mentions a device that allows the rotating of tubes by hand or that utilizes an electrical mechanism to rotate the tubes instead in order to obtain a mixture of materials contained inside the tubes.

Aforementioned embodiments in the state of the art constitute certain disadvantages in terms of ease of use due to the glass container tubes in which the process of mixing shall be carried out.

BRIEF SUMMARY OF THE INVENTION

Object of the invention is to provide a mixture of materials contained inside the soft/bag packaging by means of the mixing chamber of the planet centrifuge device.

Another object of the invention is to make soft/bag packages to take shape of the container that they're put inside by utilizing their physical characteristics through applying compressive or vacuum force.

Another object of the invention is to obtain a homogeneous mixture out of the materials to be mixed by putting them inside a geometrically well shaped container.

Another object of the invention is to achieve maximum mixing performance by means of the geometrically well shaped and rigid container included in the structure of the centrifuge.

Figure 1:
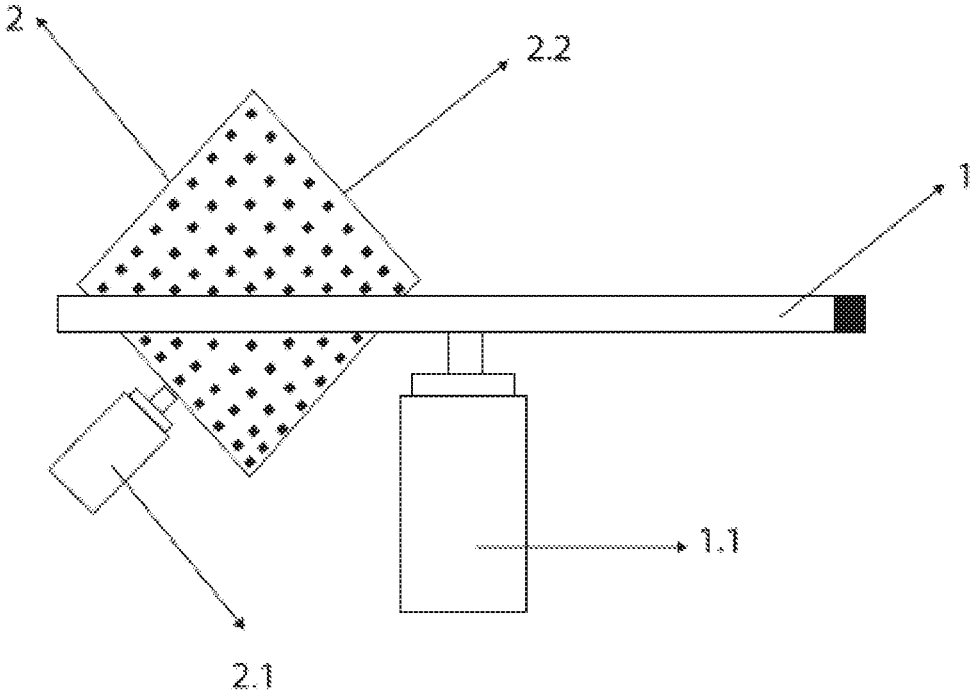
FIG. 1: Perspective view of the planet centrifuge mixing container
Figure 2:
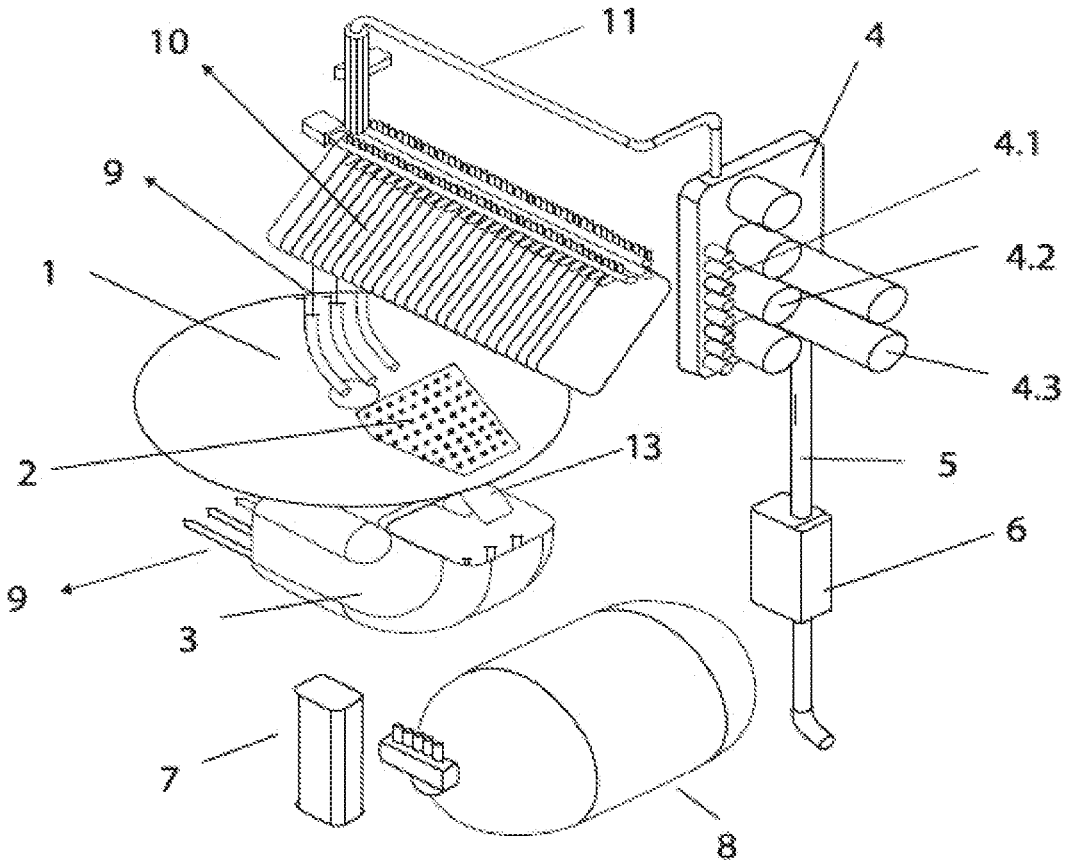
FIG. 2: Perspective view including all parts of the soft/bag package mixing system
Figure 3:
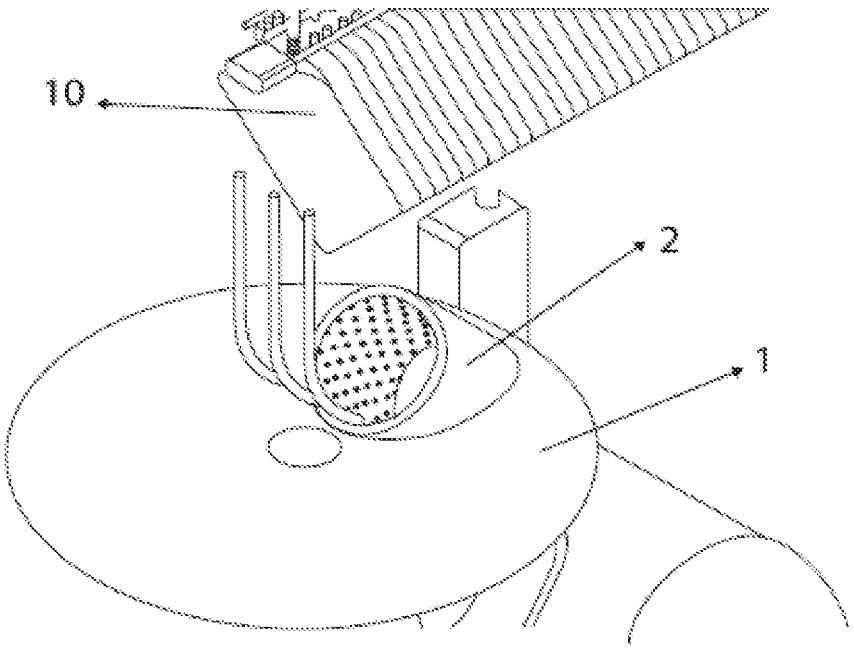
FIG. 3: Perspective view of the main centrifuge mixer and planet centrifuge mixing container
Figure 4:
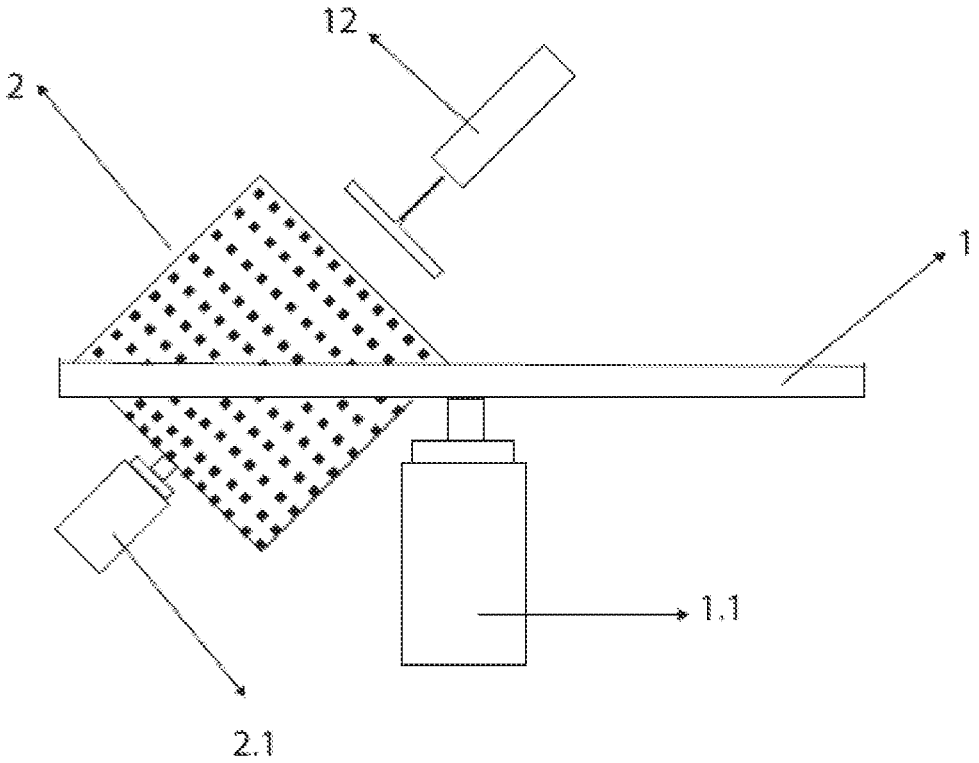
FIG. 4: Perspective view of centrifuge mixing container with pressure piston

- 1: Main centrifuge mixer
  - 1.1: Main motor
- 2: Planet centrifuge mixing container
  - 2.1: Planet Container Motor
  - 2.2: Vacuum holes
- 3: Product output channel
- 4: Capsule Station
  - 4.1: Perfume capsules
  - 4.2: Enzyme capsules
  - 4.3: Detergent extract capsules
- 5: Process water transferring pipe
- 6: Process water conditioning unit
- 7: Vacuum generator
- 8: Pressurized air compressor
- 9: Soft/bag package guide rails
- 10: Soft/Bag Package Depositor
  - 10.1: Multiple Nozzle Filling Station
  - 10.2: Capper mechanism
  - 10.3: Label printer
  - 10.4: Lid
  - 10.5: Pipe
- 11: Mixture Inputs Transferring Pipe
- 12: Pressure piston
- 13: Container discharge trap

DETAILED DESCRIPTION OF THE INVENTION

Present invention relates to a new soft/bag packaging mixing system and method that allows the mixing of materials contained in soft/bag packages and obtaining of a homogeneous mixture by utilizing the physical characteristics of said packages through applying different types of forces.

Subject matter invention soft/bag package mixing system comprises, geometrically well shaped and rigid planet centrifuge mixing container (2) that mixes the materials by rotating around its own axis, disk shaped main centrifuge mixer (1) which enables the homogeneously mixing of the materials by rotating around its own axis and on which the planet centrifuge mixing container (2) is placed in a skewed position, container discharge trap placed under the planet centrifuge mixing container (2) that allows the discharging of mixed materials, product output channel (3) placed under the container discharge trap which outputs the mixed and soft/bagged packaged materials, capsule station (4) in which the soft/bag package materials to be mixed are stored, mixture inputs transferring pipe (11) which is composed of several other transfer pipes that convey materials to be mixed from the capsule station (4) to multiple nozzle filling station (10.1), guide rails (9) at least one in number and positioned at the input and output portions of the planet centrifuge mixing container (2) that guides soft/bag package materials, capsule station (4) that carries out the action of filling of materials to be mixed to soft/bag packages and soft/bag package depositor (10) in connection with the soft/bag package guide rails (9), multiple nozzle filling station (10.1) positioned on the soft/bag package depositor (10) and that involves at least one pipe and enables the transfer of materials from the mixture inputs transfer pipe (11) to soft/bag package depositor (10), capper mechanism (10.2) placed next to the multiple nozzle filling station (10.1) that allows capping of soft/bag packages, cylindrical perfume capsules (4.1) placed in an order on top of the capsule station (4) ready to be added to soft/bag package depositor (10), cylindrical enzyme capsules (4.2) placed orderly next to the perfume capsules (4.1) ready to be added to soft/bag package depositor (10), cylindrical detergent extract capsules (4.3) placed in an order next to enzyme capsules ready to be added to soft/bag package depositor (10), process water conditioning unit (6) that carries out the purification of municipal water that reaches to capsule station (4) through the process water transferring pipe (5), vacuum generator (7) that carries out the vacuuming process and that enables the soft/bag packages to assume the shape of the planet centrifuge mixing container (2), pressurized air compressor (8) that generates pressurized air, vacuum holes (2.2) located on the surface of the planet centrifuge mixing container (2) and that enables the vacuum application, main motor (1.1) placed at the lower part of the main centrifuge mixer (1) and that allows the rotational motion of the main centrifuge mixer (1) around its own axis and planet container motor (2.1) located at the lower part of the planet centrifuge mixing container (2) and that allows the rotational motion of the planet centrifuge mixing container (2) around its own axis.

Figure 5:
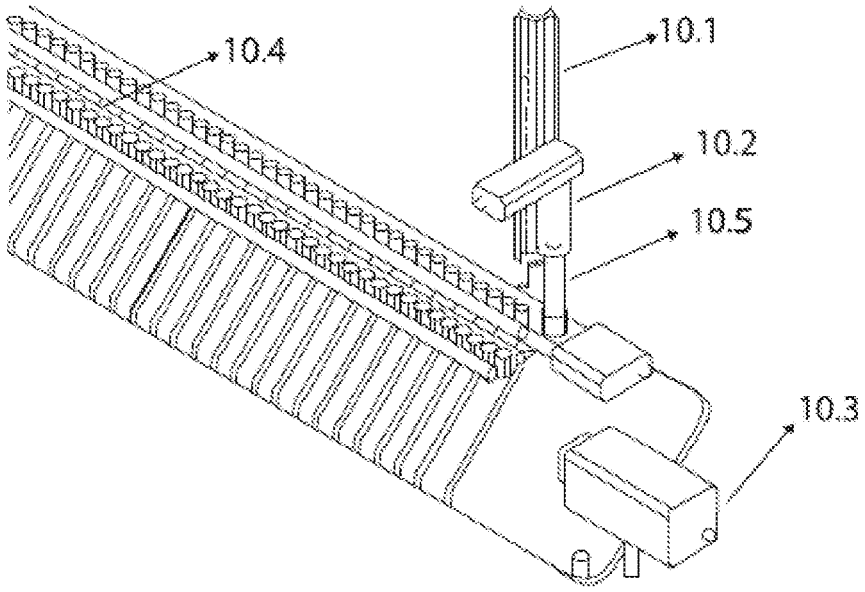
FIG. 5: Perspective view of the soft/bag package depositor The components shown in the figures are numbered and their descriptions are provided below.

In the subject matter soft/bag package mixing system invention, initially the municipal water is transferred to process water conditioning unit (6) through the process water transferring pipe (5). After the purification process is complete, water is transferred to the capsule station (4) in which the materials to be mixed are stored. Detergent extract capsules (4.3), enzyme capsules (4.2) and perfume capsules (4.1) are placed to be at least one in number on top of the capsule station (4). While the materials to be used in capsule station (4) are not limited with perfume capsules (4.1), enzyme capsules (4.2) or detergent extract capsules (4.3), materials of any nature intended to be mixed can be used in the capsule station (4) and can be transferred to soft/bag package depositor (10) in any order. Moreover, depending on the capacity, materials in the capsule station (4) can be increased in amount. Additionally, perfume capsules (4.1), enzyme capsules (4.2) and perfume capsules (4.3) bear the characteristics of being in any geometrical shape. Materials in capsule station (4) are transferred to soft/bag package depositor (10) in any intended order through the mixture inputs transferring pipe (11). In the soft/bag package depositor (10), processes such as filling of soft/bag packages with materials intended to be mixed, capping and labeling are carried out. In this process, materials that are intended to be mixed are sent to multiple nozzle filling station (10.1) through the mixture inputs transferring pipe (11). As it can be deduced from the FIG. 5, transferring pipe on the multiple nozzle filling station (10.1) of the material to be filled in can move downwardly. Pursuant to the aforesaid operation, the filling process of soft/bag packages that are held in standby state with their intake open in the soft/bag package depositor (10) is carried out. Later on, capper mechanism (10.2) performs the capping of soft/bag packages. Finally, the labelling process is carried out. Subsequently, soft/bag packages are sent to planet centrifuge mixing container (2) by the medium of soft/bag package guide rails (9). Planet centrifuge mixing container (2) allows the mixing of materials inside by drawing off to the wall peripheries of the soft/bag planet centrifuge mixing container (2) by means of vacuum holes (2.2) it inherently possesses. Hence, though temporarily, soft/bag packages gain the characteristic of rigidity. This particular process is conducted by way of transferring the air generated by the pressurized air compressor (8) to the vacuum generator (7). After the mixing process is completed, soft/bag package is separated from the unit by opening the planet container discharge trap. Later on, soft/bag packages are sent to product output channel (3) through the soft/bag package guide rails (9). Hence, mixed materials gain ready-to-use status and become end product for users.

Soft/bag package mixing system,

Comprises the steps of, transferring of municipal water to process water conditioning unit (6) through the process water transferring pipe (5), Transferring the purified water in process water conditioning unit (6) to capsule station (4) by means of the process water transferring pipe (5), Transferring of materials stored in the capsule station (4) that are intended to be mixed to the multiple nozzle filling station (10.1) by way of mixture inputs transferring pipe (11), Filling of soft/bag packages placed in soft/bag package depositor (10) which are coming from the multiple nozzle filling station (10.1), Capping of filled soft/bag packages by way of the capper mechanism (10.2), Labelling capped soft/bag packages by means of the label printer (10.3), Transferring of soft/bag packages in which mixing operation shall be carried out to planet centrifuge mixing container (2) through soft/bag package guide rails (9), Homogeneously mixing the materials by shaping soft/bag package to have a rigid form by means of drawing off the soft/bag package with vacuum to wall peripheries of the planet centrifuge mixing container (2), Transferring mixed soft/bag package to product output channel (3) by means of planet container discharge trap and soft/bag package guide rails (9).

In the process step in which mixing of materials contained inside soft/bag package planet centrifuge mixing container (2) with vacuum by drawing off to the wall peripheries of the soft/bag package planet centrifuge mixing container (2), the operation of drawing off of the soft/bag package to planet centrifuge mixing container (2) wall peripheries can also be carried out by using the pressure piston (12) instead of vacuum in the subject matter invention of soft/bag package mixing system. Thus, by enabling the application of vacuum and/or pressure forces, materials contained inside soft/bag packages can maintain an orderly form throughout the process of mixing. Planet centrifuge mixing container (2) rotates both around the axis of main centrifuge mixer (1) that it is connected to and its own axis by means of the planet container motor (2.1). By this means, a homogeneous mixture of materials that are intended to be mixed inside soft/bag packages can be acquired.

Soft/bag package guide rails (9) that are included in the structure of the subject matter invention of soft/bag package mixing system are made out of metal and/or rigid plastic materials and can be increased in number arbitrarily.

Soft/bag packages that are not rigid and not geometrically well shaped are subjected to the application of pressure piston and/or vacuum force. By this means, soft/bag packages temporarily gain a rigid and an orderly geometrical shape and materials inside are successfully mixed bearing a homogeneous characteristic. Thus, depending on the demands of the user, liquid products with different features can be brought into use as end products. Additionally, the subject matter invention has a liquid detergent preparation unit which can instantly produce different liquid detergents with low or high viscosity and with various characteristics, functionalities, perfume/scent, detergent potency and with specific stain removing features according to the type of the stain depending on the user's preferences.

The invention claimed is:

1. A soft bag/package mixing system comprising:

a rigid planet centrifuge mixing container (2) that mixes materials by rotating around an axis of the planet centrifuge mixing container, a disk shaped main centrifuge mixer (1) which enables homogeneously mixing of the materials by rotating around an axis of the disk shaped main centrifuge mixer (1) and on which the planet centrifuge mixing container (2) is placed in a skewed position, a container discharge trap placed under the planet centrifuge mixing container (2) that allows discharging of mixed materials, a product output channel (3) placed under the container discharge trap which outputs the mixed materials, a capsule station (4) in which the materials to be mixed are stored, a mixture inputs transferring pipe (11) which is composed of several other transfer pipes that convey the materials to be mixed from the capsule station (4) to a multiple nozzle filling station (10.1), at least one soft bag/package guide rail (9) positioned at an input portion and an output portion of the planet centrifuge mixing container (2) that guides the materials, a soft bag/package depositor in connection with at least one soft bag/package guide rail (9) fills soft bags/packages with the materials to be mixed, the multiple nozzle filling station (10.1) positioned on the soft bag/package depositor (10) and that involves at least one pipe and enables transfer of the materials from the mixture inputs transferring pipe (11) to the soft bag/package depositor (10), a capper mechanism (10.2) placed next to the multiple nozzle filling station (10.1) that allows capping of soft bags/packages, cylindrical perfume capsules (4.1) placed in an order on top of the capsule station (4) ready to be added to the soft bag/package depositor (10), cylindrical enzyme capsules (4.2) placed orderly next to the perfume capsules (4.1) ready to be added to the soft bag/package depositor (10), cylindrical detergent extract capsules (4.3) placed in an order next to the enzyme capsules ready to be added to the soft bag/package depositor (10), a process water conditioning unit (6) that carries out the purification of municipal water that reaches to the capsule station (4) through the process water transferring pipe (5), a vacuum generator (7) that carries out a vacuuming process and that enables the soft bags/packages to assume a shape of the planet centrifuge mixing container (2), a pressurized air compressor (8) that generates pressurized air, vacuum holes (2.2) located on a surface of the planet centrifuge mixing container (2) and that enables a vacuum application, a main motor (1.1) placed at a lower part of the main centrifuge mixer (1) and that allows the rotational motion of the main centrifuge mixer (1) around the axis of the centrifuge mixer (1), and a planet container motor (2.1) located at a lower part of the planet centrifuge mixing container (2) and that allows the rotational motion of the planet centrifuge mixing container (2) around the axis of the planet centrifuge mixing container (2).

2. A material mixing method, comprising:

transferring of municipal water to a process water conditioning unit (6) through a process water transferring pipe (5), transferring purified water in the process water conditioning unit (6) to a capsule station (4) by means of the process water transferring pipe (5), transferring of materials stored in the capsule station (4) that are intended to be mixed to a multiple nozzle filling station (10.1) by way of mixture inputs transferring pipe (11), filling of soft bags/packages placed in soft bag/package depositor (10) which are coming from the multiple nozzle filling station (10.1), capping of filled soft bags/packages by way of a capper mechanism (10.2), labelling capped soft bags/packages by means of a label printer (10.3), transferring of capped soft bags/packages in which a mixing operation shall be carried out to a planet centrifuge mixing container (2) through soft bag/package guide rails (9), homogeneously mixing the materials by shaping a soft bag/package to have a rigid form by means of drawing off the soft bag/package with vacuum to wall peripheries of the planet centrifuge mixing container (2), transferring a mixed soft bag/package to a product output channel (3) by means of a planet container discharge trap and the soft bag/package guide rails (9).

* * * * *